US012264875B2

(12) United States Patent
Kang et al.

(10) Patent No.: US 12,264,875 B2
(45) Date of Patent: Apr. 1, 2025

(54) REFRIGERATOR

(71) Applicant: LG Electronics Inc., Seoul (KR)

(72) Inventors: Chanuk Kang, Seoul (KR); Sanghun Cho, Seoul (KR); Changjae Lee, Seoul (KR); Yonghyun Cho, Seoul (KR); Dongrim Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 17/780,666

(22) PCT Filed: Sep. 2, 2020

(86) PCT No.: PCT/KR2020/011786
§ 371 (c)(1),
(2) Date: May 27, 2022

(87) PCT Pub. No.: WO2021/107345
PCT Pub. Date: Mar. 6, 2021

(65) Prior Publication Data

US 2023/0266057 A1 Aug. 24, 2023

Related U.S. Application Data

(60) Provisional application No. 62/941,761, filed on Nov. 28, 2019, provisional application No. 62/944,338, filed on Dec. 5, 2019.

(51) Int. Cl.

| | |
|---|---|
| ***F25D 27/00*** | (2006.01) |
| ***F25D 23/02*** | (2006.01) |
| ***F25D 29/00*** | (2006.01) |

(52) U.S. Cl.
CPC ..... *F25D 27/005* (2013.01); *F25D 23/028* (2013.01); *F25D 29/008* (2013.01); *F25D 2400/361* (2013.01)

(58) Field of Classification Search
CPC ..... F25D 2323/021; F25D 23/04; F25D 2327/001; F25D 27/005; F25D 23/028; F25D 29/008; F25D 23/02
See application file for complete search history.

(56) References Cited

U.S. PATENT DOCUMENTS

| | | | |
|---|---|---|---|
| 9,046,294 | B2 | 6/2015 | Lee et al. |
| 10,378,815 | B2 | 8/2019 | Lee |
| 2014/0320647 | A1 | 10/2014 | Seo et al. |

(Continued)

FOREIGN PATENT DOCUMENTS

| | | |
|---|---|---|
| CN | 108120205 | 6/2018 |
| EP | 3287723 | 2/2018 |

(Continued)

OTHER PUBLICATIONS

WO-2014208585-A1 translation.*

(Continued)

*Primary Examiner* — Elizabeth J Martin
(74) *Attorney, Agent, or Firm* — Fish & Richardson P.C.

(57) ABSTRACT

A refrigerator includes a cabinet having a storage space, a door configured to open and close the storage space, a first display disposed on the door, and a second display spaced apart from the first display, configured to operate to be interlocked with the first display, and having a plurality of light emitting portions.

21 Claims, 15 Drawing Sheets

(56) References Cited

U.S. PATENT DOCUMENTS

| | | | | |
|---|---|---|---|---|
| 2017/0370636 | A1 | 12/2017 | Koo et al. | |
| 2018/0310726 | A1* | 11/2018 | Oh | F25D 23/028 |
| 2018/0372394 | A1 | 12/2018 | Kim et al. | |
| 2021/0396454 | A1* | 12/2021 | Cho | F25D 29/003 |

FOREIGN PATENT DOCUMENTS

| | | | | |
|---|---|---|---|---|
| EP | 3418658 | | 12/2018 | |
| EP | 3633513 | | 4/2020 | |
| JP | 2016-006379 | | 1/2016 | |
| JP | 2016-061556 | | 4/2016 | |
| JP | 2016-205637 | | 12/2016 | |
| KR | 20060021959 | | 3/2006 | |
| KR | 20080105927 | | 12/2008 | |
| KR | 10-2010-0023351 | | 3/2010 | |
| KR | 10-2011-0068422 | | 6/2011 | |
| KR | 20160045545 | | 4/2016 | |
| KR | 20180060888 | | 6/2018 | |
| KR | 20190024415 | | 3/2019 | |
| KR | 10-2019-0097638 | | 8/2019 | |
| WO | WO2012028551 | | 3/2012 | |
| WO | WO 2014/208585 | | 12/2014 | |
| WO | WO-2014208585 | A1 * | 12/2014 | F25D 11/00 |

OTHER PUBLICATIONS

Office Action in Australian Appln. No. 2020393453, mailed on Jul. 31, 2023, 5 pages.

Office Action in European Appln. No. 20893096.6, mailed on Nov. 29, 2023, 16 pages.

Office Action in Australian Appln. No. 2020393453, mailed on Dec. 15, 2023, 6 pages.

Extended European Search Report in European Appln. No. 20897341.2, mailed on Mar. 18, 2024, 12 pages.

Notice of Allowance in Australian Appln. No. 2020396667, mailed on Mar. 28, 2024, 4 pages.

* cited by examiner

REFRIGERATOR

CROSS-REFERENCE TO RELATED APPLICATIONS

This application is a National Stage application under 35 U.S.C. § 371 of International Application No. PCT/KR2020/011786, filed on Sep. 2, 2020, which claims the benefit of U.S. Provisional Application No. 62/941,761, filed on Nov. 28, 2019, and U.S. Provisional Application No. 62/944,338, filed on Dec. 5, 2019. The disclosures of the prior applications are incorporated by reference in their entirety.

TECHNICAL FIELD

Embodiments relate to a refrigerator.

BACKGROUND ART

In general, a refrigerator is a home appliance for storing foods in an internal storage space, which is shield by a door, at a low temperature by low temperature air. For this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. The refrigerators may be classified into various types according to an arranged configuration of the storage space and a structure of the door that opens and closes the storage space.

A separate accommodation space accessible from the outside may be provided in the door of the refrigerator. The accommodation space may be accessed by opening a partial auxiliary door or a home bar door without opening the entire refrigerator door through the above-described accommodation space.

Thus, frequently used foods may be stored in the separate accommodation space provided in the refrigerator door. Since the entire refrigerator door is not opened for accommodating food, there is an advantage of minimizing leakage of cold air inside the refrigerator.

However, even in such a structure, there is a problem in that the food is not checked unless the refrigerator door is opened. That is, the door should be opened to identify whether desired food is received in a space in the refrigerator or in a separate storage space provided in the door. If there is no desired food when opening the auxiliary door or the home bar, there is inconvenience to open the main door again. Here, there is a problem that unnecessary leakage of cold air occurs.

In order to solve this problem, a portion of a front surface of the refrigerator door may be made of a transparent material, but in this case, an insulation problem in the refrigerator may occur. In addition, when the inside of the refrigerator is seen even when the refrigerator is not in use, there is a problem in that the foods are exposed to the outside as it is, which is very bad in appearance.

As a prior art document, there is Korean Patent Publication No. 10-2016-0045545.

DISCLOSURE

Technical Problem

Embodiments provide a refrigerator in which foods stored in the refrigerator are directly checked while a door is closed.

Embodiments provide a refrigerator in which information is displayed on different types of displays when the door is closed to provide a variety of information to a user.

Technical Solution

A refrigerator according to one aspect includes: a cabinet having a storage space; a door configured to open and close the storage space; a first display disposed on the door; and a second display spaced apart from the first display, configured to operate to be interlocked with the first display, and having a plurality of light emitting portions.

When the first display is turned on, the second display may be turned on. When the second display is turned on, one or more light emitting portions of the plurality of light emitting portions may be turned on.

The plurality of light emitting portions may be arranged in a line in a horizontal direction.

The refrigerator may further include a speaker provided on the cabinet or the door, wherein the speaker may operate when at least the first display is turned on.

In a state in which the speaker does not operate, the light emitting pattern of the plurality of light emitting portions may be constantly maintained.

A light emitting pattern of the plurality of light emitting portions may vary according to an intensity of sound output from the speaker.

The number of light emitting portions, which are turned on, may vary according to the intensity of the sound. The number of light emitting portions, which are turned on, when the intensity of the sound corresponds to a first level may be greater than that of light emitting portions, which are turned on, when the intensity of the sound corresponds to a second level greater than the first level.

Each of the light emitting portions, which are turned on, may vary in color according to the intensity of the sound.

Each of the light emitting portions, which are turned on, may vary in luminous intensity according to the intensity of the sound.

When the intensity of the sound corresponds to the first level, the predetermined number of light emitting portions may be turned on, some of the light emitting portions, which are turned on, may emit light having a first color, and others may emit light having a second color.

When the intensity of the sound corresponds to the second level greater than the first level, one or more of the number of light emitting portions that emit the light having the first color and the number of light emitting portions that emit the light having the second color may vary.

Each of the light emitting portions, which are turned on, may vary in position according to the intensity of the sound.

The second display may be disposed between the first display and a lower end of the door.

The door may include: a main door having an opening; and a sub door configured to open and close the main door, wherein the first and second displays may be provided on the sub door.

The sub door may include: an outer plate having a first opening; a door liner having a second opening corresponding to the first opening; and a panel assembly configured to cover the first opening and the second opening.

The first display may be provided on the panel assembly.

The refrigerator may further include an outer bracket configured to connect the panel assembly to the outer plate. The second display may be installed on the outer bracket.

The panel assembly may include a front panel and one or more insulating panels spaced apart from the front panel.

The front panel may include: a first area through which light is transmitted; a second area disposed outside the first area to restrict the transmission of the light; and a third area disposed between a lower end of the first area and a lower end of the front panel to transmit light emitted from the light emitting portions, which are turned on.

Advantageous Effects

According to the proposed invention, there may be the advantage in that the foods stored in the refrigerator are directly checked while the door is closed.

Since the plurality of different types of displays exist on the door, there may be the advantage in that the user checks the various information on the plurality of displays.

MODE FOR CARRYING OUT THE INVENTION

Figure 1:
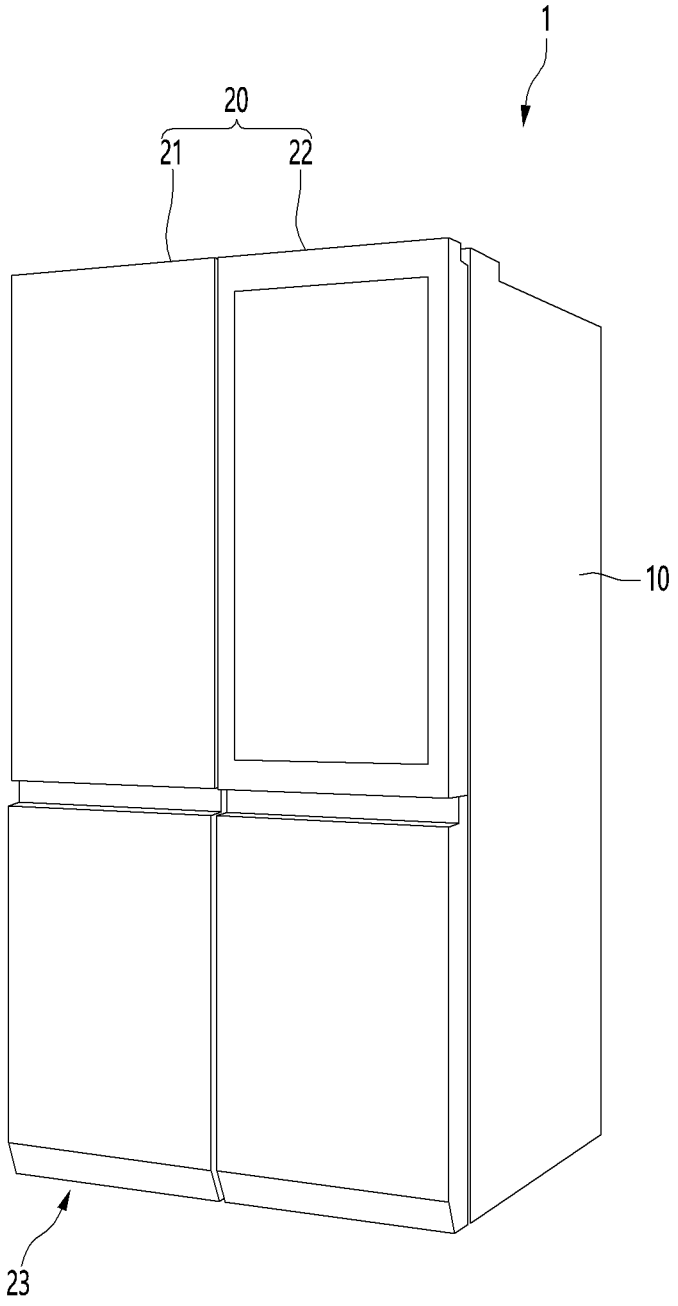
FIG. 1 is a perspective view of a refrigerator according to an embodiment.

Hereinafter, some embodiments of the present invention will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. The terms are merely used to distinguish the corresponding component from other components, and do not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
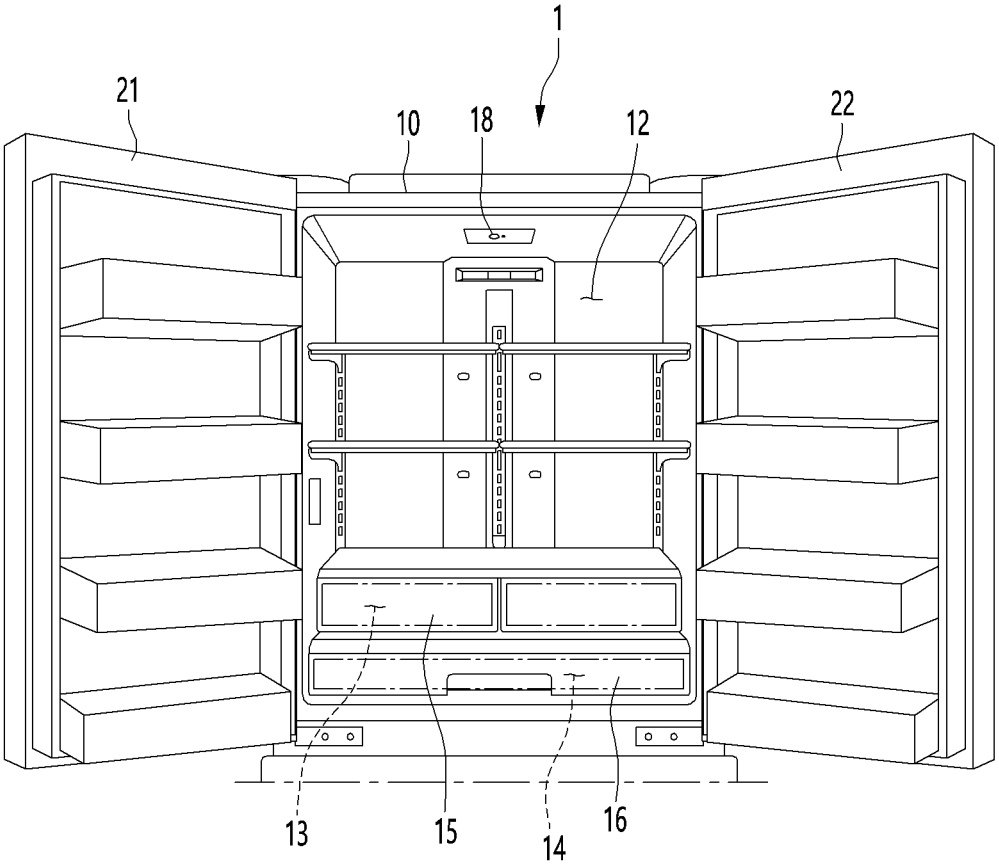
FIG. 2 is a view illustrating a state in which a refrigerating compartment door is opened according to an embodiment.
Figure 3:
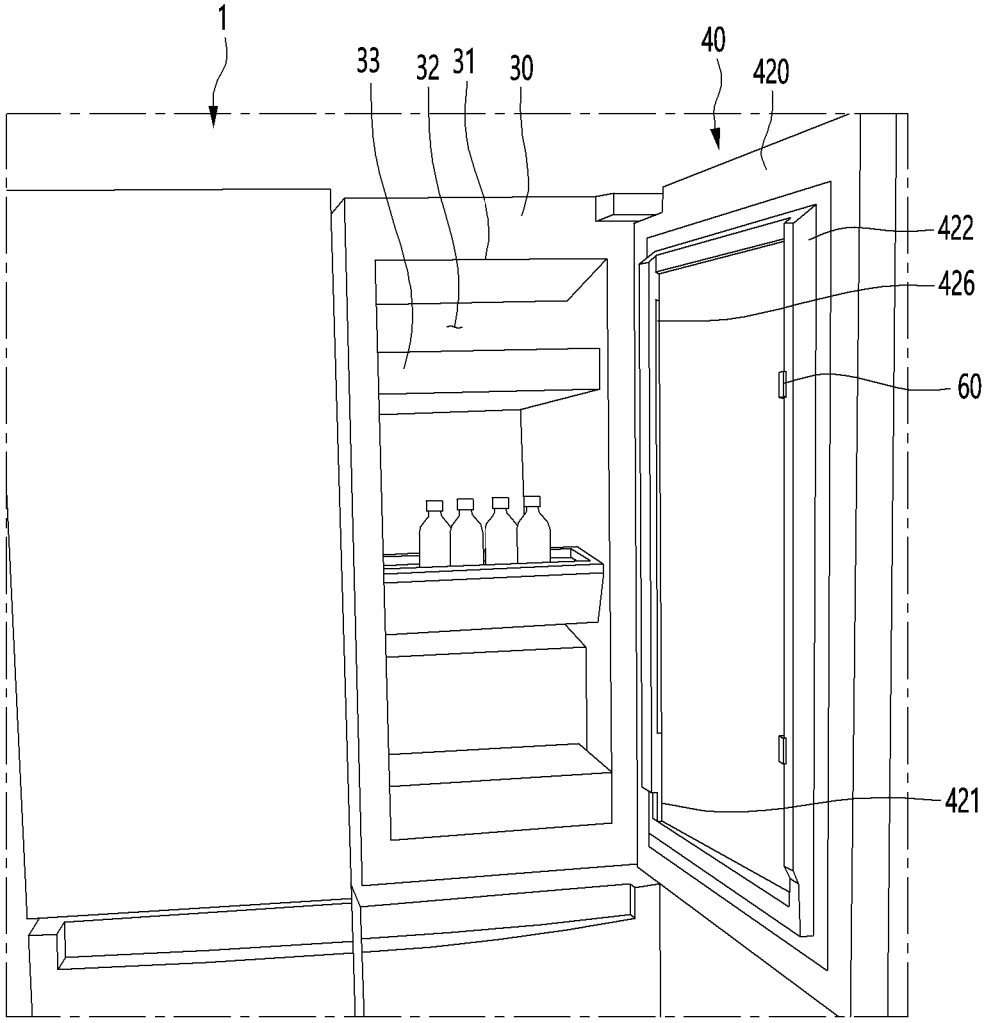
FIG. 3 is a view illustrating a state in which a sub door is opened according to an embodiment.
Figure 4:
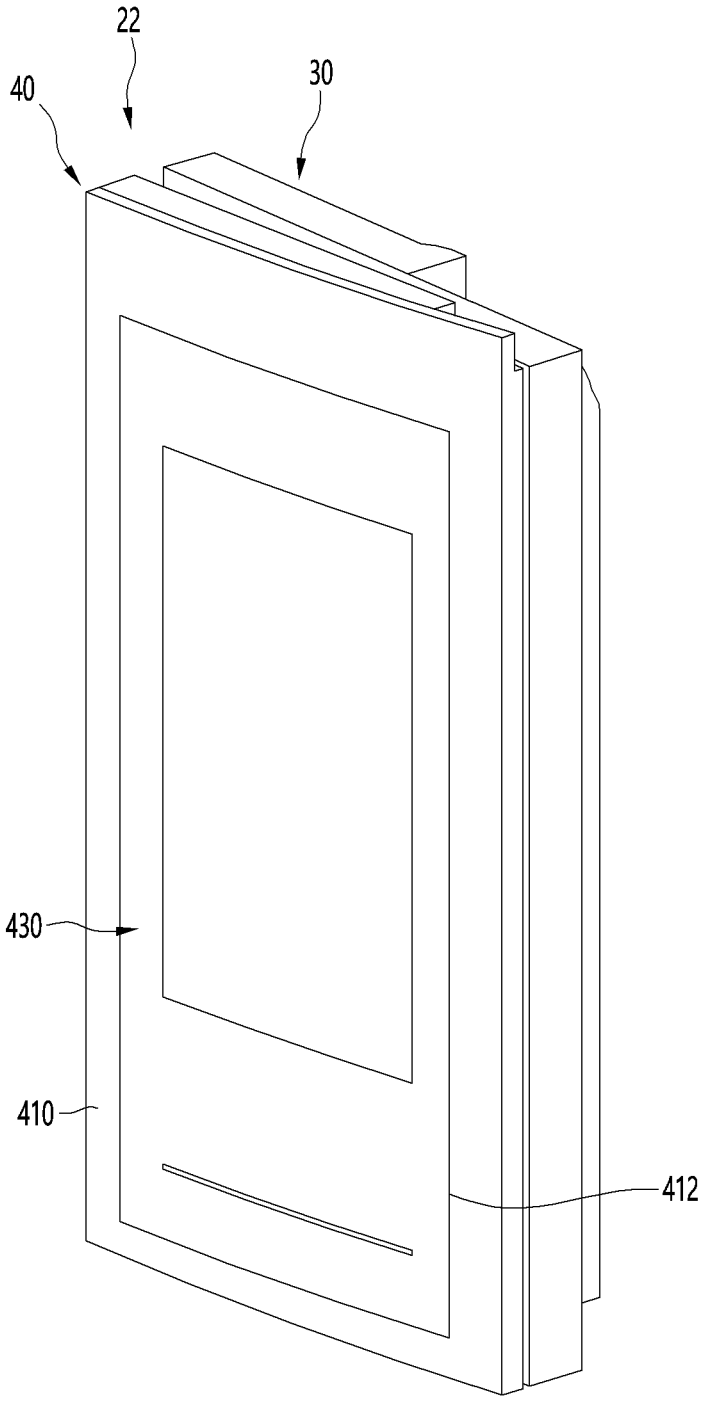
FIG. 4 is a perspective view of a refrigerating compartment door according to an embodiment.

FIG. 1 is a perspective view of a refrigerator according to an embodiment, and FIG. 2 is a view illustrating a state in which a refrigerating compartment door is opened according to an embodiment. FIG. 3 is a view illustrating a state in which a sub door is opened according to an embodiment, and FIG. 4 is a perspective view of a refrigerating compartment door according to an embodiment.

Referring to FIGS. 1 to 4, a refrigerator 1 according to an embodiment may include a cabinet 10 defining a storage space and doors 20 and 30 to open and close the storage space.

The storage space may include, for example, a refrigerating compartment 12. The refrigerating compartment 12 may be opened and closed by the refrigerating compartment door 20.

When the storage space additionally includes a freezing compartment, the freezing compartment may be opened and closed by a freezing compartment door 23. FIG. 1 illustrates an example in which the refrigerator 1 includes the refrigerating compartment 12 and the freezing compartment.

The refrigerating compartment 12 may be disposed above or below the freezing compartment or disposed at a left or right side of the freezing compartment.

The refrigerating compartment door 20 may include a first refrigerating compartment door 21 and a second refrigerating compartment door 22, which are disposed at left and right sides, respectively. Each of the first and second refrigerating compartment doors 21 and 22 may be rotatably connected to the cabinet 10 by a hinge.

The freezing compartment door 23 may include a single door or a plurality of independently operating doors. When the freezing compartment door 23 includes the plurality of doors, at least one of the plurality of doors may be slidably connected to the cabinet 10 or may be rotatably connected to the cabinet 10 by the hinge.

At least one or more of the first and second refrigerating compartment doors 21 and 22 may include a main door 30 and a sub door 40. FIG. 3 illustrates an example in which the second refrigerator door 22 includes the main door 30 and the sub door 40.

The main door 30 may open and close the refrigerating compartment 12, and the sub door 40 may rotate with respect to the main door 30. The sub door 40 may be rotatably connected to the main door 30 or the cabinet 10.

A size of a front surface of the sub door 40 may be the same as that of a front surface of the main door 30. In this case, the sub door 40 may be disposed to overlap the main door 30 in a state in which the sub door 40 is disposed in front of the main door 30.

Alternatively, the size of the front surface of the sub door 40 may be less than that of the front surface of the main door 30. In this case, a space in which the sub door 40 is disposed may be provided in the front surface of the main door 30, and the sub door 40 may be accommodated in the space. Then, the front surface of the sub door 40 may form a continuous surface with the front surface of the main door 30.

The inside of the refrigerating compartment 12 may be divided into a plurality of spaces by one or more shelves. The refrigerating compartment 12 may include one or more divided storage spaces 13 and 14.

The storage spaces 13 and 14 may include a vegetable space. The vegetable space may be an internal space of a substantially slidable drawer 15 (or a first drawer).

The storage spaces 13 and 14 may include multi accommodation spaces. The multi accommodation space may be an internal space of a slidable drawer 16 (or a second drawer).

In order to easily check the inside of the storage spaces 13 and 14, a user has to open the refrigerator compartment door 20 and then the drawers 15 and 16 again, which may be cumbersome for the user.

Thus, the refrigerator 1 may further include a storage space camera 18 for photographing the storage spaces 13 and 14 in a state in which the drawers 15 and 16 are opened.

The storage spaces 13 and 14 may be disposed at a lower portion in the refrigerating compartment 12. In this case, the storage space camera 18 may be disposed to be close to a front end of an upper wall of the refrigerating compartment 12. Thus, in the state in which the drawers 15 and 16 are opened, the storage space camera 18 may look at the storage spaces 13 and 14, and thus, the storage spaces 13 and 14 may be photographed by the storage space camera 18.

For example, a discharge portion for discharging cold air toward the refrigerating compartment door 20 may be provided on an upper wall of the refrigerating compartment 12, and the storage space camera 18 may be disposed at a rear side of the discharge portion. The refrigerator 1 may further include a storage space lighting portion (see reference numeral 172 of FIG. 12). The storage space lighting portion may be disposed at a rear side of the storage space camera 18. That is, the storage space camera 18 may be disposed between the discharge portion and the storage space lighting portion.

Although not shown, the refrigerator 1 may further include a sensing portion for sensing movement of the drawers 15 and 16. When movement of each of the drawers 15 and 16 to a specific position is sensed by the sensing portion, the storage space camera 18 photographs the storage spaces 13 and 14. For example, when a position at which each of the drawers 15 and 16 is completely withdrawn is sensed by the sensing portion, the storage space camera 18 may photograph the storage spaces 13 and 14. A photographing surface or lens of the storage space camera 18 may be inclined toward a front side of the cabinet 10 so that the storage space camera 18 photographs the inside of each of the drawers 15 and 16 at the position at which the drawers 15 and 16 are completely withdrawn.

Referring to FIG. 3, the main door 30 may include an opening 31. In addition, the main door 30 may include a door storage portion 32. The door storage portion 32 may include a door basket 33 fixed to or detachably connected to the main door 30. In addition, the door storage portion 32 may include a space between the plurality of door baskets 33.

The opening 31 may be covered by the sub door 40. When the sub door 40 is opened, the user may access the door storage portion 32 through the opening 31.

The sub door 40 may include an outer plate 410 and a door liner 420.

The outer plate 410 may form a front surface of the sub door 40. The outer plate 410 may be made of a metal material. The outer plate 410 may include a first opening 412.

The door liner 420 may include a second opening 421. The second opening 421 may be disposed to face the first opening 412.

The sub door 40 may further include a panel assembly 430. The panel assembly 430 may be disposed to cover the first opening 412 and the second opening 421. The door storage portion 32 may be seen from the outside by the panel assembly 430.

The door liner 420 may include a pair of door dikes 422. The pair of door dikes 422 may be a portion of the door liner 420, which protrudes toward the cabinet 10 and may be disposed in the opening 31 of the main door 30 in a state in which the sub door 40 is closed. The door dike 422 may serve to block leakage of the cold air from the refrigerating compartment 12.

A door camera 60 may be provided on at least one or more of the door liner 420 and the panel assembly 430.

FIG. 3 illustrates an example in which the door camera 60 is disposed on the door liner 420.

The door camera 60 may photograph the door storage portion 32. A vertical length of the door storage portion 32 may be greater than a left and right length of the door storage portion 32. Thus, a plurality of door cameras 60 may be vertically spaced apart from each other and disposed on the door liner 420 so that the door camera 60 photographs the entire area of the door storage portion 32.

For example, the door camera 60 may be provided on one door dike 422 of the pair of door dikes 422.

The one door dike 422 is a door dike 422 having a large rotational radius around the hinge during the rotation of the sub door 40 in the pair of door dikes 422.

A plurality of door cameras 60 may be disposed to be vertically spaced apart from each other on the one door dike 422.

The door dike 422 may be provided with a door lighting portion 426. The door lighting portion 426 may be vertically disposed in an elongated shape. The door lighting portion 426 may be turned on when a turn-on command is input in the state in which the sub door 40 is closed. When the door lighting portion 426 is turned on, the user may check the foods stored in the door storage portion 32 in the state in which the sub door 40 is closed.

As another example, the door lighting portion 426 may be provided on the main door 30. Even in this case, when the turn-on command is input in the state in which the sub door 40 is closed, the door lighting portion 426 may be turned on.

Figure 5:
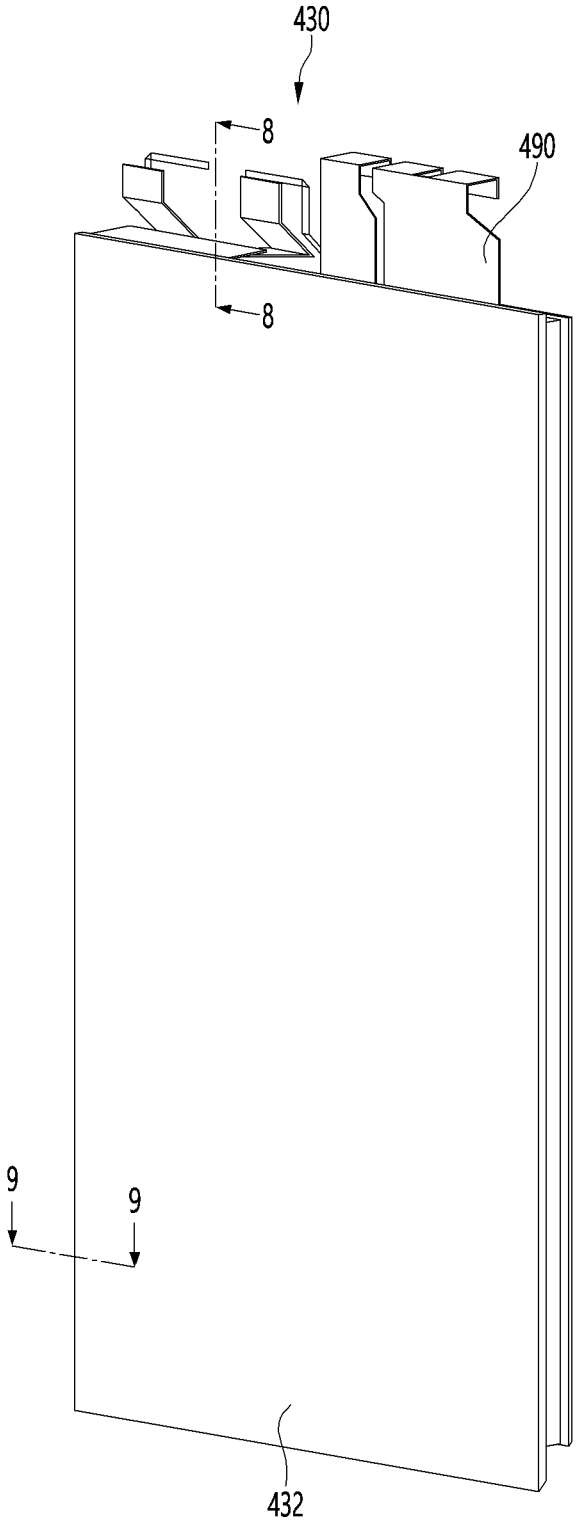
FIG. 5 is a perspective view of a panel assembly according to an embodiment.
Figure 6:
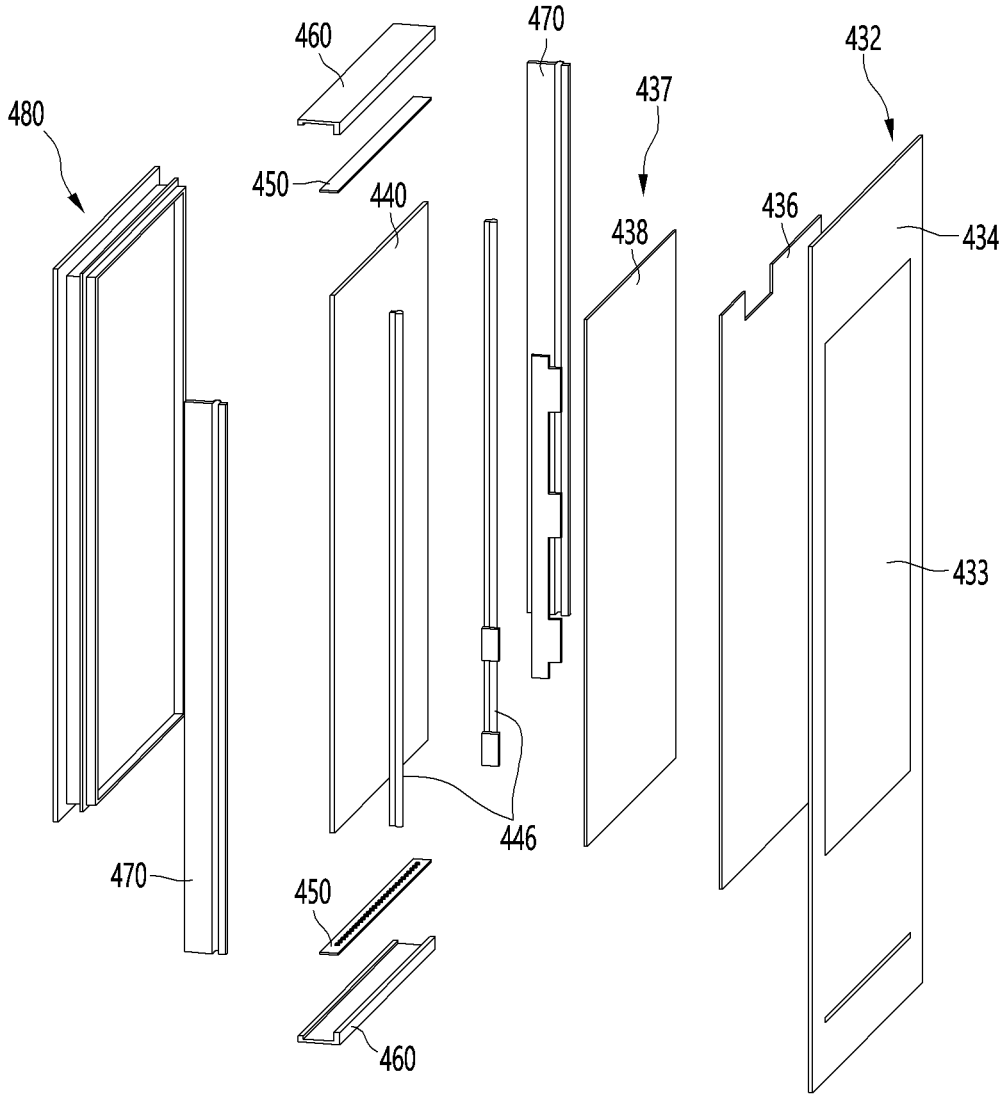
FIG. 6 is an exploded perspective view of the panel assembly of FIG. 5.
Figure 7:
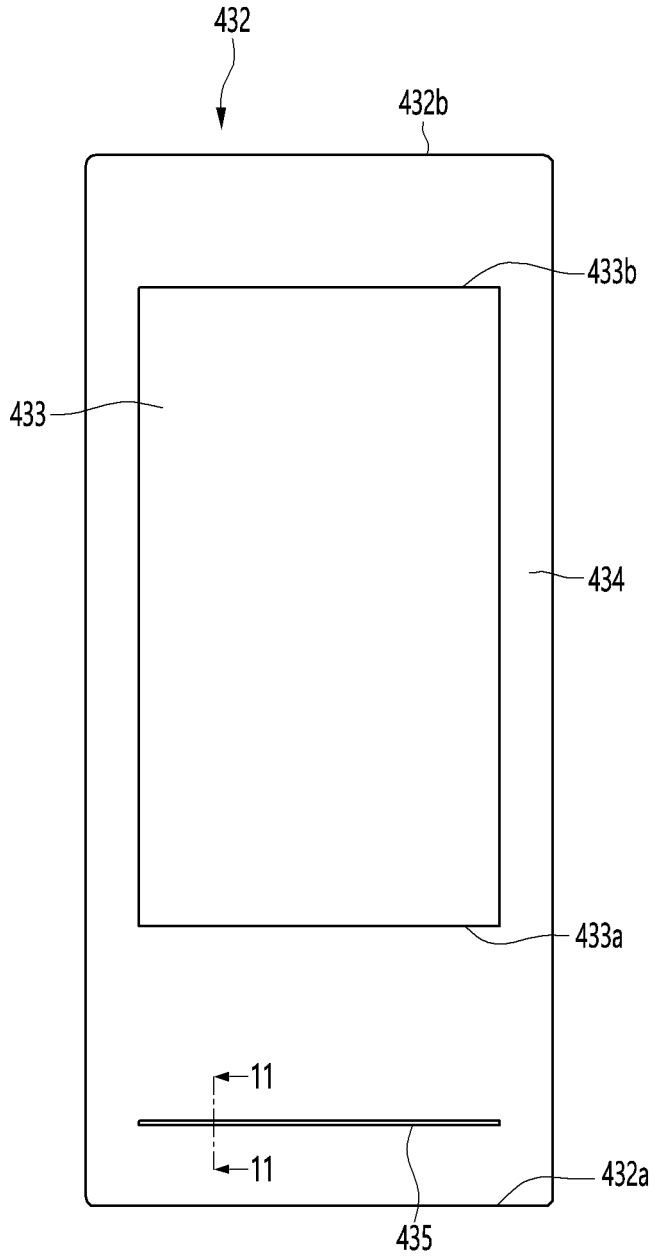
FIG. 7 is a front view of a front panel according to an embodiment.
Figure 8:
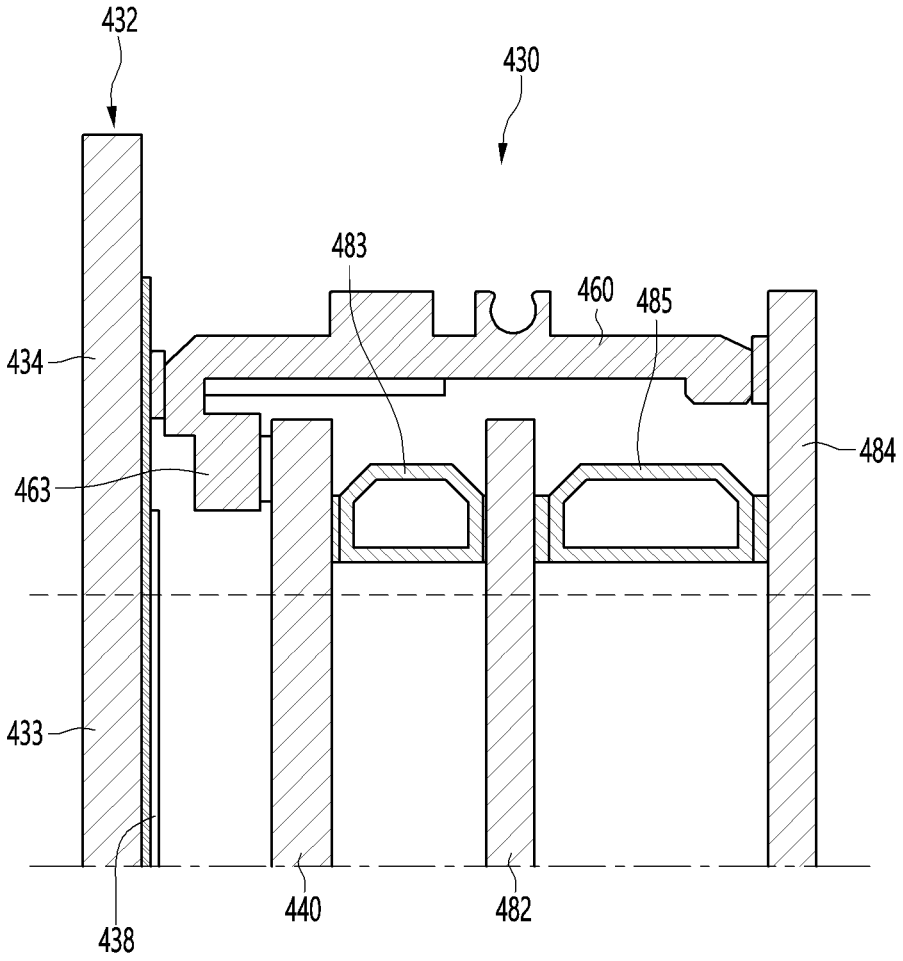
FIG. 8 is a cross-sectional view taken along line 8-8 of FIG. 5.
Figure 9:
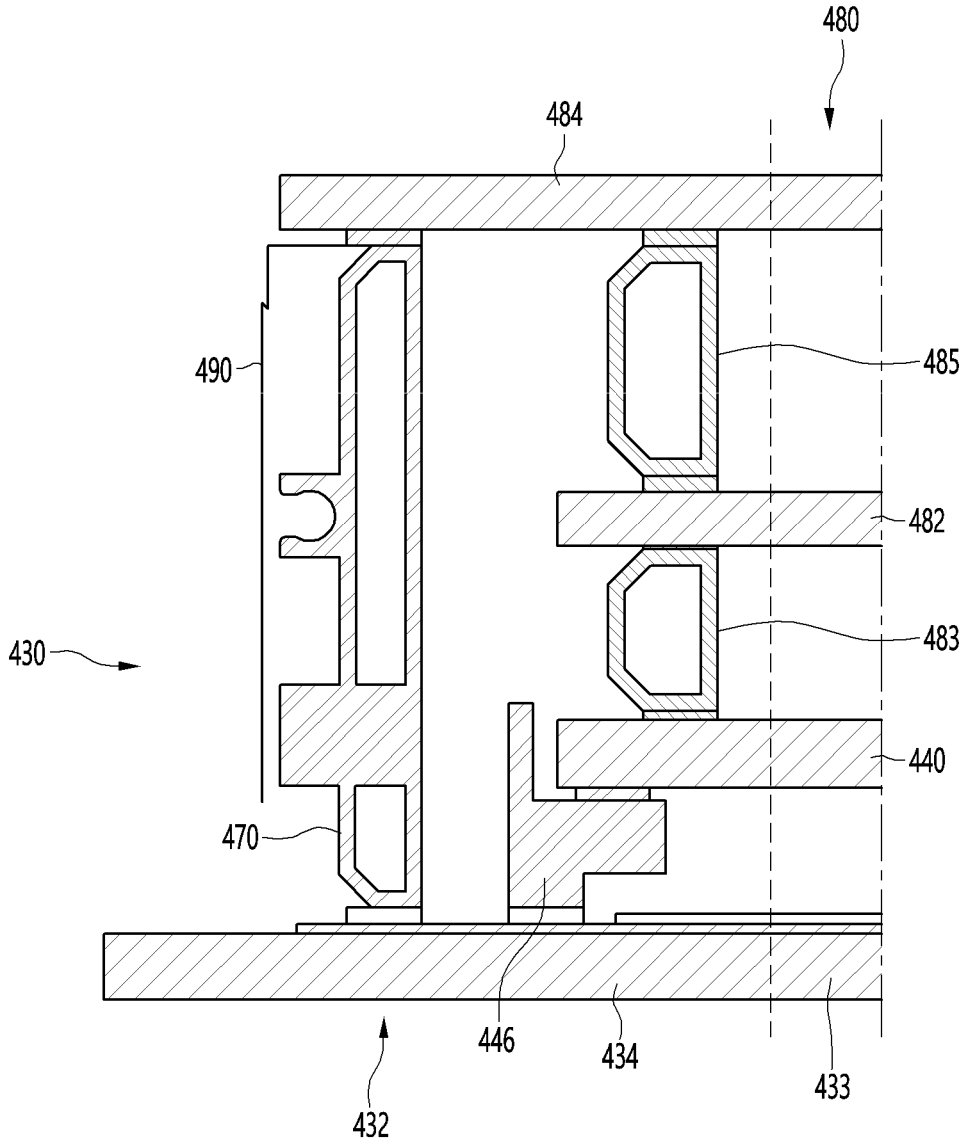
FIG. 9 is a cross-sectional view taken along line 9-9 of FIG. 5.

FIG. 5 is a perspective view of a panel assembly according to an embodiment, and FIG. 6 is an exploded perspective view of the panel assembly of FIG. 5. FIG. 7 is a front view of a front panel according to an embodiment, FIG. 8 is a cross-sectional view taken along line 8-8 of FIG. 5, and FIG. 9 is a cross-sectional view taken along line 9-9 of FIG. 5.

Referring to FIGS. 5 to 9, the panel assembly 430 according to this embodiment may include a front panel 432.

The front panel 432 may form an outer appearance of the front surface of the sub door 40. The front panel 432 may be made of a glass material.

A printed layer may be provided on a portion of a rear surface of the front panel 432. The printed layer may restrict light transmission of the door lighting portion 426 or a storage space lighting portion to be described later.

Since the printed layer is provided, the front panel 432 may include a first portion 433 through which light is transmitted and a second portion 434 through which light transmission is restricted. The second portion 434 has light transmittance less than that of the first portion 433. The transmission of light in the second portion 434 may be completely blocked, or transmittance of the second portion 434 may decrease by the printed layer. In this specification, the second portion 434 may be referred to as a bezel portion.

A distance between a lower end 433*a* of the first portion 433 and a lower end 432*a* of the front panel 432 is greater than that between an upper end 433*b* of the first portion 433 and an upper end 432*b* of the front panel 432.

The front panel 432 may further include a third portion 435. The third portion 435 is an area through which light passes.

The third portion 435 is disposed lower than the first portion 433. That is, the third portion 435 may be disposed between the first portion 433 and the lower end 432*a* of the front panel 432. A distance between the third portion 435 and the lower end 433*a* of the first portion 433 is greater than that between the third portion 435 and the lower end 432*a* of the front panel 432.

A vertical length of the first portion 433 may be greater than a left and right length of the first portion 433. A vertical length of the third portion 435 may be less than a left and right length of the third portion 435. The third portion 435 may extend in the form of a straight band.

The left and right length of the first portion 433 may be substantially the same as the left and right length of the third portion 435.

The panel assembly 430 may further include a first display 437.

The first display 437 may further include a touch panel 436 for a touch input and an LCD panel 438 on which a screen is output. The touch panel 436 may be disposed at a rear side of the front panel 432, and the LCD panel 438 may be disposed at a rear side of the touch panel 436. The touch panel 436 and the LCD panel 438 may be disposed to face the first portion 433.

The panel assembly 430 may further include a light guide plate 440. The light guide plate 440 may be disposed at a rear side of the LCD panel 438. The light guide plate 440 may be disposed to face at least the first portion 433.

The panel assembly 430 may further include a spacer 446 disposed between the light guide plate 440 and the front panel 432. For example, the light guide plate 440 may be spaced apart from the front panel 432 by the spacer 446. The light guide plate 440 may be supported by the spacer 446. For example, the light guide plate 440 may be supported in a state in which the plurality of spacers 446 are spaced apart from each other in a left and right direction.

The spacer 446 may be disposed to face the second portion 434 of the front panel 432 to prevent the spacer 446 from being exposed to the outside.

An entire area of the spacer 446 may be disposed to face the second portion 434 of the front panel 432.

The panel assembly 430 may further include a display light 450 for irradiating light to the light guide plate 440. For example, the display light 450 may be disposed above and below the light guide plate 440. The display light 450 may include, for example, a substrate and a plurality of light emitting portions (LEDs) arranged on the substrate.

The panel assembly 430 may include a supporter 460 for supporting the display light 450. For example, one supporter of the pair of supporters 460 may support the display light 450 at an upper side of the light guide plate 440, and the other supporter may support the display light 450 at a lower side of the light guide plate 440.

A portion 463 of the supporter 460 may be disposed between the front panel 432 and the light guide plate 440. A portion 463 of the supporter 460 may serve as a spacer for separating the front panel 432 from the light guide plate 440. The supporter 460 may be made of, for example, a metal material. Although not limited, the supporter 460 may be made of an aluminum material.

The supporter 460 may be disposed to correspond to the second portion 434 of the front panel 432 to prevent the supporter 460 from being exposed to the outside.

The panel assembly 430 may further include an insulating glass assembly 480. The insulating glass assembly 480 may include one or more insulating panels.

FIG. 8 illustrates an example in which the insulating glass assembly 480 includes a plurality of insulating panels.

The insulating glass assembly 480 may be disposed at a rear side of the light guide plate 440. The insulating glass assembly 480 includes a first insulating panel 482 disposed at the rear of the light guide plate 440 and a second insulating panel 484 disposed at the rear side of the first insulating panel 482.

A first spacer 483 may be disposed between the light guide plate 440 and the first heat insulating panel 482. A second spacer 485 may be disposed between the first insulating panel 482 and the second insulating panel 484.

For example, the light guide plate 440 and the first insulating panel 482 may be spaced apart from each other by the first spacer 483. The first insulating panel 482 and the second insulating panel 484 may be spaced apart from each other by the second spacer 485.

In the panel assembly 430, the second heat insulating panel 484 may be disposed at the rearmost side, and thus, the second heat insulating panel 484 may be referred to as a rear panel.

The first spacer 483 and the second spacer 485 may be disposed to correspond to the second portion 434 of the front panel 432 so that the first spacer 483 and the second spacer 485 are prevented from being exposed to the outside. For example, the first spacer 483 and the second spacer 485 may be disposed to face the second portion 434 of the front panel 432. A portion of the first heat insulating panel 482 may also be disposed to face the second portion 434 of the front panel 432. A portion of the second heat insulating panel 484 may also be disposed to face the second portion 434 of the front panel 432.

A left and right length and a vertical length of the second insulating panel 484 may be greater than those of the first insulating panel 482.

The panel assembly 430 may further include an outer frame 470. The outer frame 470 may be disposed between the front panel 432 and the second heat insulating panel 484. For example, a pair of outer frames 470 may be disposed to be spaced apart from each other in the left and right direction.

The outer frame 470 may be disposed to be spaced apart from the supporter 460 in a horizontal direction. Also, the outer frame 470 may be disposed to be spaced apart from the light guide plate 440 and the first heat insulating panel 482.

The panel assembly 430 may further include a cable 490 connected to the LCD panel 438 or the display light 450. The cable 490 may pass between the outer frame 470 and the second insulating panel 484.

Figure 10:
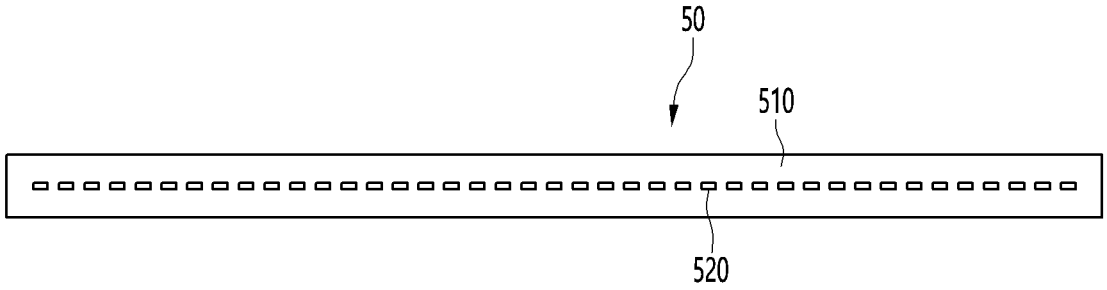
FIG. 10 is a view of a second display according to an embodiment.
Figure 11:
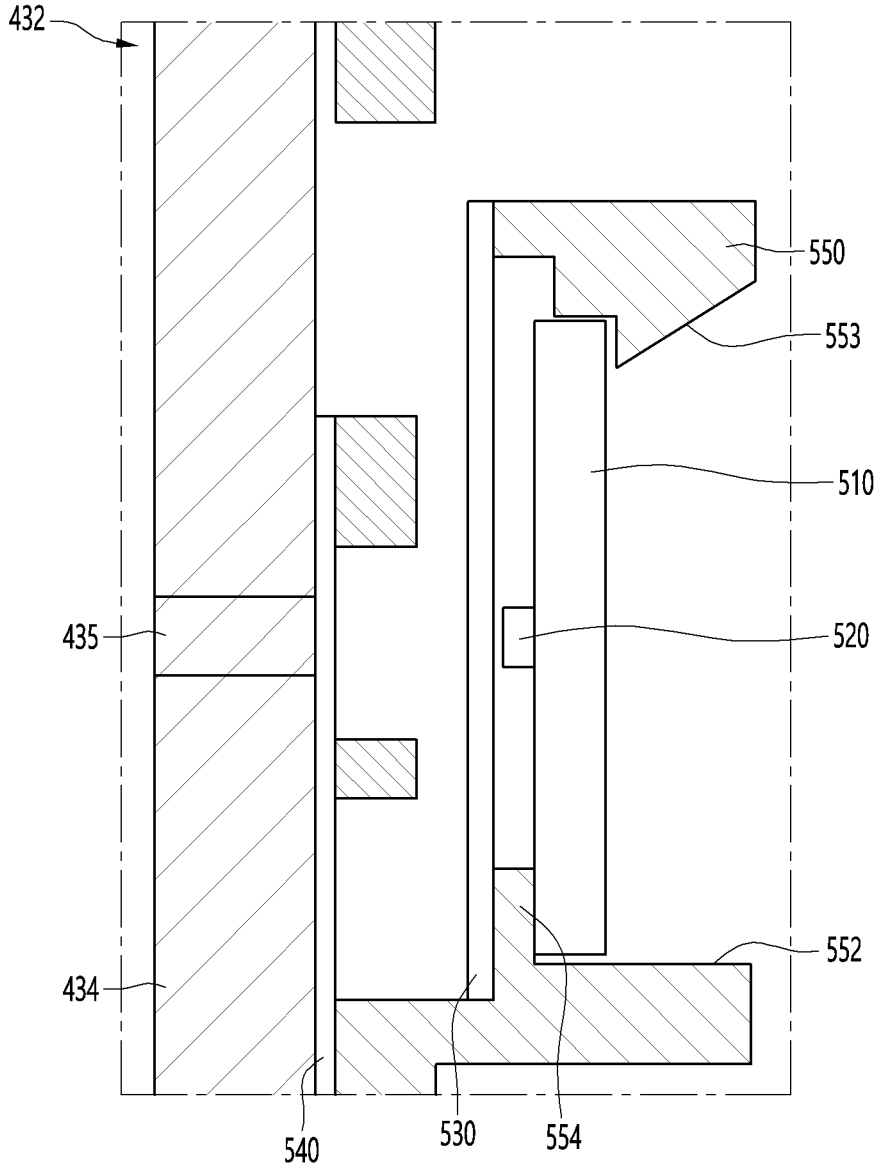
FIG. 11 is a cross-sectional view taken along line 11-11 of FIG. 8.

FIG. 10 is a view of a second display according to an embodiment, and FIG. 11 is a cross-sectional view taken along line 11-11 of FIG. 8.

Referring to FIGS. 10 and 11, the panel assembly 430 may further include a second display 50. The second display 50 may include, for example, a substrate 510 and a plurality of light emitting portions 520 installed on the substrate 510. Each of the light emitting portions 520 may be a white LED or an RGB LED.

Light irradiated from the plurality of light emitting portions 520 may pass through the third portion 435. The plurality of light emitting portions 520 may be arranged to be spaced apart in the horizontal direction, for example, may be arranged to face the third portion 435.

The sub door 40 may further include an outer bracket 550 disposed to surround the panel assembly 430. The outer bracket 550 may, for example, connect the outer plate 410 to the front panel 432.

A first surface of the outer bracket 550 may be connected to a rear surface of the front panel 432, and a second surface may be connected to a rear surface of the outer plate 410.

The second display 50 may be installed on the outer bracket 550. For example, the outer bracket 550 may be provided with an installation groove 552. When the substrate 510 is inserted into the installation groove 552 from the rear side of the outer bracket 550, the substrate 510 is hooked by the hook 553 after the substrate 510 passes through an elastically deformable hook 553. Thus, the position of the substrate 510 may be fixed by the hook 553.

A stopper 554 is provided on the outer bracket 550 to restrict movement of the substrate 510 when the substrate 510 is inserted into the installation groove 552.

A first diffusion sheet 530 may be provided between the second display 50 and the front panel 432. A second diffusion sheet 540 may be provided between the front panel 432 and the first diffusion sheet 530. For example, the second diffusion sheet 540 may be attached to the rear surface of the front panel 432.

Each of the plurality of light emitting portions 520 may be independently turned on/off. Some or all of the plurality of light emitting portions 520 may be changed in color.

Some or all of the plurality of light emitting portions 520 may be turned on, or the color of the turn-on light emitting portions may be changed. A length, color, brightness, etc. of light viewed outward from the third portion 435 may vary according to the number of light emitting portions 520 that are turned on.

Figure 12:
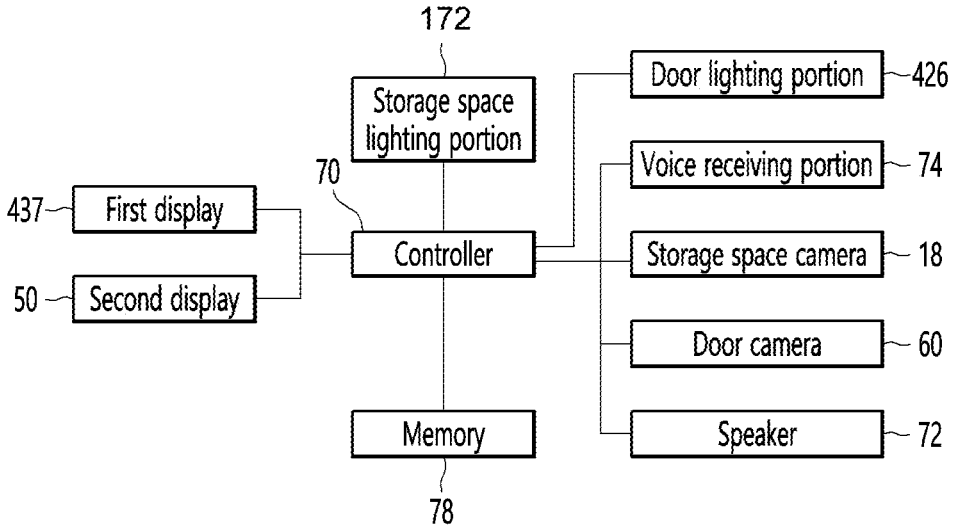
FIG. 12 is a block diagram of a refrigerator according to an embodiment.
Figure 13:
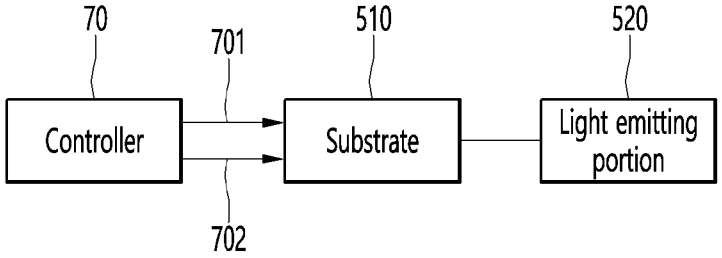
FIG. 13 is a block diagram illustrating control of a controller and a second display.
Figure 14:
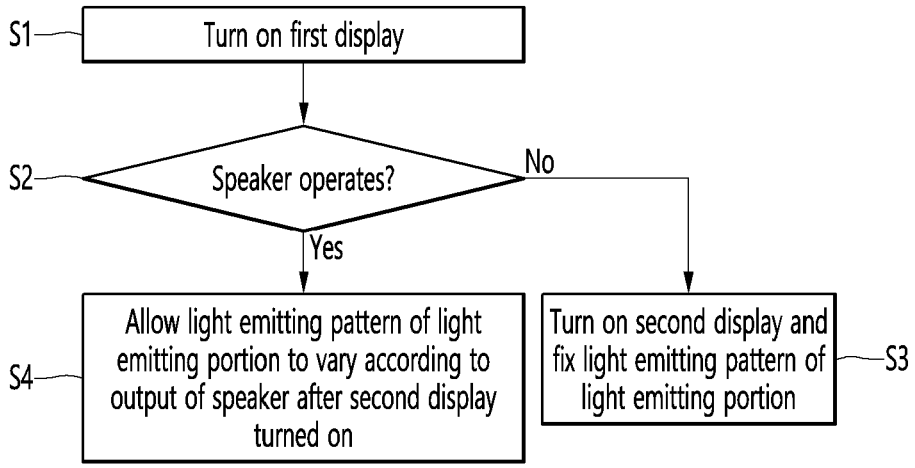
FIG. 14 is a flowchart for explaining a method for controlling first and second displays according to an embodiment.
Figure 15:
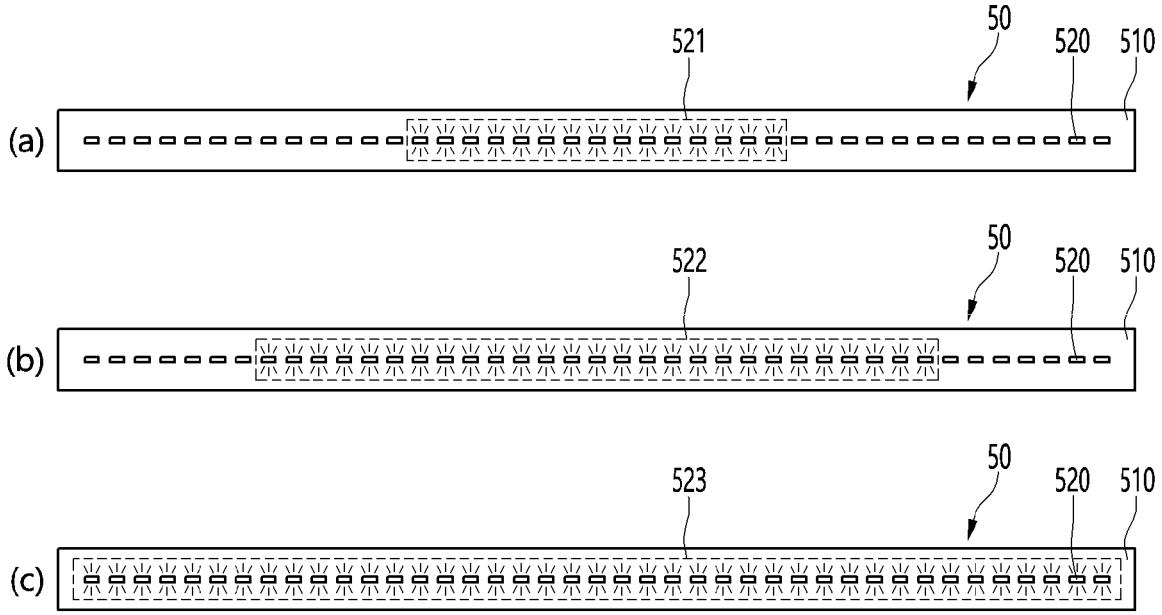
FIG. 15 is a view for explaining an emission pattern of a light emitting portion in the second display.

FIG. 12 is a block diagram of the refrigerator according to an embodiment, and FIG. 13 is a block diagram illustrating control of a controller and a second display. FIG. 14 is a flowchart for explaining a method for controlling first and second displays according to an embodiment. FIG. 15 is a view for explaining an emission pattern of the light emitting portion in the second display.

Referring to FIGS. 12 to 15, the refrigerator 1 according to this embodiment may further include a controller 70. The controller 70 may control an overall operation of the refrigerator 1, control operations of some of the components constituting the refrigerator 1, or control some functions provided in the refrigerator 1.

The refrigerator 1 may further include a storage space lighting portion 172. The storage space lighting portion 172 may be turned on when the doors 20 and 23 are opened. The storage space lighting portion 172 may be provided in the cabinet 10 and may be provided in each of the freezing compartment and the refrigerating compartment 12.

The refrigerator 1 may include the first display 437 and the second display 50, which are described above.

When the controller 70 receives a first operation command, the first display 437 may operate. The first display 437 may operate, for example, in a state in which the main door 30 and the sub door 40 are closed.

When the controller 70 receives a second operation command, the second display 50 may operate. For example, the second display 50 may receive an operation command input from a voice receiving portion 74, operate in conjunction with the operation of the first display 437, or operate to correspond to a change in state of the refrigerator 1. Hereinafter, the operation of the second display 50 in conjunction with the operation of the first display 437 will be described in detail.

When receiving a knock-on command applied to the front panel 432, the controller 70 may turn on the door lighting portion 426 in the state in which the sub door 40 is closed. In this case, the user may check the inside of the door storage portion 32 in the state in which the sub door 40 is closed.

The controller 70 may turn off the door lighting portion 426 when the opening of the sub door 40 is sensed.

If the door lighting portion 426 is provided on the main door 30, the door lighting portion 426 may maintain the turn-on state even when the sub door 40 is opened.

The refrigerator 1 may further include a speaker 72 (or a sound output portion). The speaker 72 may be provided in the cabinet 10 or the doors 20 and 23.

The speaker 72 may operate in conjunction with the first display 437 or may operate independently of the first display 437.

When the speaker 72 operates independently of the first display 437, the speaker 72 is configured so that the refrigerator 1 is in a specific state, or a specific command is input from the voice receiving portion 74.

When the speaker 72 operates in conjunction with the first display 437, when the first display 437 is turned on, the speaker 72 is in an operable state. In the state in which the speaker 72 is turned on, a sound may be output from the speaker 72, or the speaker 72 may not operate according to information displayed on the first display 437. An intensity of the sound output from the speaker 72 may vary according to the type of information.

When the first display 437 is turned on, the second display 50 may be turned on. At least one or more of the plurality of light emitting portions 520 may be turned on to turn on the second display 50.

Specifically, when the first display 437 is turned on, the controller 70 transmits a signal 702 (a second signal) including state information of the speaker 72 together with a turn-on signal 701 (a first signal) of the light emitting portion 520 to the substrate 510.

The second signal 702 may include turn-on or off information of the speaker 72 and information on the intensity of the sound output from the speaker 72. Alternatively, the second signal 702 may include information on the intensity of the sound output from the speaker 72.

Referring to FIG. 14, when a turn-on condition of the first display 437 is satisfied, the first display 437 may be turned on (S1). When the first display 437 is turned on, the speaker 72 may or may not operate according to the information displayed on the first display 437.

The controller 70 may determine whether the speaker 72 operates in the state in which the first display 437 is turned on (S2).

When the speaker 72 operates, the intensity of the sound output from the speaker 72 may vary.

When the first display 437 is turned on, the controller 70 may transmit the turn-on signal of the light emitting portion 520 to the substrate 510.

When the speaker 72 does not operate, the controller 70 may transmit a signal including the turn-off information of the speaker 72 to the substrate 510.

In this case, the substrate 510 turns on some or all of the plurality of light emitting portions 520. When the speaker 72 does not operate, a light emission pattern of the light emitting portion 520 that is turned on may be fixed (S3). For example, the turned-on light emitting portion 520 may be maintained in the turn-on state, and light emission intensity and color may be constantly maintained.

On the other hand, when the speaker 72 operates, the controller 70 may transmit the signal including the information on the intensity of the sound output from the speaker 72 together with the turn-on information of the speaker 72 to the substrate 510.

Alternatively, when the speaker 72 operates, the controller 70 may transmit the signal including the information on the intensity of the sound output from the speaker 72 to the substrate 510.

In any case, when the substrate 510 receives the signal 702 including the sound intensity information, the light emitting pattern of the light emitting portion 520 is determined based on the received signal. That is, in the state in which the light emitting portion 520 is turned on, the light emitting pattern may be changed (S4).

When the intensity of the sound is changed, the substrate 510 may control the light emitting pattern of the light emitting portion 520 to vary.

In this case, the light emission pattern of the light emitting portion 520 may include one or more of the number of light emitting portions 520 that are turned on, positions of the light emitting portions 520 that are turned on, light emission intensities of the light emitting portions 520 that are turned on, and emission colors of the light emitting portions 520 that are turned on.

The variable light emission pattern of the light emitting portion 520 may indicate that at least one or more of the number of light emitting portions 520 that are turned on, the positions of the light emitting portions 520 that are turned on, the light emission intensities of the light emitting portions 520, and the emission colors of the light emitting portions 520 are turned on vary.

For example, referring to FIG. 15, a sound intensity may be divided into a plurality of levels.

When the sound intensity is a first level, a first group 521 among the plurality of light emitting portions 520 may be turned on (N light emitting portions are turned on).

When the sound intensity is a second level greater than the first level, a second group 522 of the plurality of light emitting portions 520 may be turned on (M light emitting portions are turned on, where M is greater than N).

When the sound intensity is a third level greater than the second level, a third group 523 of the plurality of light emitting portions 520 may be turned on (all the light emitting portions are turned on).

In FIG. 15, as an example, the variation of the emission pattern of the light emitting portion when divided into three levels has been described, but the level division of the sound intensity is not limited thereto.

In the case of FIG. 15, the first group 521 is, for example, set as a light emitting portion disposed at a center among the plurality of light emitting portions 520, but the position of the light emitting portion that is turned on may vary. For example, when the intensity of the sound is the first level, N light emitting portions may be turned on from light emitting portions disposed at a left or right end. When the sound intensity is the second level, M light emitting portions may be turned on from the light emitting portions disposed at the left or right end.

As another example, the same number of light emitting portions that are turned on may be remained, and the color or intensity of each of the light emitting portions that are turned on may vary according to the sound intensity.

When the sound intensity is the first level, the predetermined number of light emitting portions may be turned on, and the light emitting portions that are turned on may emit light with a first color or a first intensity. When the intensity of the sound is the second level, the predetermined number of light emitting portions may be turned on, and the light emitting portions that are turned on may emit light with a second color or a second intensity.

When the sound intensity is the first level, the predetermined number of light emitting portions may be turned on, some of the light emitting portions that are turned on may emit light having the first color, and others may emit light having the second color. When the sound intensity is the second level, the predetermined number of light emitting portions may be turned on, and the number of light emitting portions emitting light having the first color and the number of light emitting portions emitting light having the second color may vary.

Unlike the above embodiment, the main door may not include the sub door. In this case, the first display and the second display may be disposed on the main door.

The invention claimed is:

1. A refrigerator comprising:

a cabinet that defines a storage space;

a main door that is configured to open and close at least a portion of the storage space and that defines an opening;

a sub door configured to open and close the opening defined at the main door;

a first display disposed at the sub door; and a second display spaced apart from the first display and configured to operate based on operation of the first display, the second display comprising a plurality of light emitting portions, wherein the sub door comprises:

an outer plate that defines a first opening, a door liner that defines a second opening facing the first opening, a panel assembly that covers the first opening and the second opening, and an outer bracket that connects the panel assembly to the outer plate, and wherein the second display is coupled to the outer bracket.

2. The refrigerator of claim 1, wherein the second display is configured to be turned on based on the first display being turned on.

3. The refrigerator of claim 2, wherein the second display is configured to, based on the second display being turned on, turn on one or more light emitting portions among the plurality of light emitting portions.

4. The refrigerator of claim 1, wherein the plurality of light emitting portions are arranged along a line extending in a horizontal direction.

5. The refrigerator of claim 1, further comprising a speaker disposed at the cabinet or the main door and configured to operate based on the first display being turned on, and wherein the second display is configured to vary a light emitting pattern of the plurality of light emitting portions in accordance with an intensity of sound output from the speaker.

6. The refrigerator of claim 5, wherein the second display is configured to, in a state in which the speaker does not operate, maintain the light emitting pattern of the plurality of light emitting portions.

7. The refrigerator of claim 5, wherein the second display is configured to vary a number of light emitting portions to be turned on among the plurality of light emitting portions in accordance with the intensity of the sound.

8. The refrigerator of claim 7, wherein the second display is configured to increase the number of the light emitting portions to be turned on based on an increase of the intensity of the sound.

9. The refrigerator of claim 5, wherein the second display is configured to vary a color of each of the light emitting portions to be turned on in accordance with the intensity of the sound.

10. The refrigerator of claim 5, wherein the second display is configured to vary a luminous intensity of each of the light emitting portions to be turned on in accordance with the intensity of the sound.

11. The refrigerator of claim 5, wherein the second display is configured to, based on the intensity of the sound corresponding to a first level, turn on a predetermined number of light emitting portions among the plurality of light emitting portions, the predetermined number of light emitting portions comprising a first number of light emitting portions that emit light in a first color and a second number of light emitting portions that emit light in a second color different from the first color.

12. The refrigerator of claim 11, wherein the second display is configured to, based on the intensity of the sound corresponding to a second level greater than the first level, vary the first number of the light emitting portions and the second number of the light emitting portions.

13. The refrigerator of claim 5, wherein the second display is configured to vary a position of each of the light emitting portions to be turned on in accordance with the intensity of the sound.

14. The refrigerator of claim 1, wherein the second display is disposed between the first display and a lower end of the main door.

15. The refrigerator of claim 1, wherein the outer bracket is disposed to surround the panel assembly.

16. The refrigerator of claim 1, wherein the outer bracket is provided with an installation groove.

17. The refrigerator of claim 16, wherein the second display further comprises a substrate on which the plurality of light emitting portions are installed, and wherein a stopper is provided on the outer bracket and is configured to, based on the substrate being inserted into the installation groove, restrict movement of the substrate.

18. The refrigerator of claim 1, wherein the panel assembly comprises a front panel and one or more insulating panels spaced apart from the front panel, and wherein the front panel comprises:

a first area configured to transmit light, a second area disposed outside the first area and configured to block light, and a third area disposed between a lower end of the first area and a lower end of the front panel and configured to transmit light emitted from the plurality of light emitting portions.

19. The refrigerator of claim 18, wherein the third area is disposed between the first area and the second area, and wherein the plurality of light emitting portions face the third area and are disposed rearward relative to the third area.

20. The refrigerator of claim 19, wherein the panel assembly further comprises a diffusion sheet that is disposed between the front panel and the plurality of light emitting portions and covers a rear side of the third area or a front side of the plurality of light emitting portions.

21. The refrigerator of claim 1, wherein the panel assembly comprises:

a front panel;

one or more insulating panels spaced apart from the front panel; and a diffusion sheet attached to a rear surface of the front panel, and wherein the outer bracket is spaced apart from the diffusion sheet.

* * * * *